United States Patent [19]

Boswell et al.

[11] 4,019,453

[45] Apr. 26, 1977

[54] UNDERWATER VEHICLE

[75] Inventors: Vance F. Boswell, Rocky River; Robert L. Shoemaker, Wickloff, both of Ohio

[73] Assignee: The United States of America as represented by the Secretary of the Navy, Washington, D.C.

[22] Filed: Nov. 18, 1965

[21] Appl. No.: 508,600

[52] U.S. Cl. ..... 114/16 R; 114/245; 114/16 F

[51] Int. Cl.[2] ..... B63G 8/18; B63G 8/00; B63C 11/48

[58] Field of Search ..... 114/20–22, 114/16; 340/7

[56] References Cited

UNITED STATES PATENTS

| | | | |
|---|---|---|---|
| 2,465,696 | 3/1949 | Paslay | 340/7 X |
| 2,992,794 | 7/1961 | Boyd | 114/22 X |
| 3,001,498 | 9/1961 | Karp | 114/20 |
| 3,084,654 | 4/1963 | Rosenberg et al. | 114/20 X |

*Primary Examiner*—Samuel W. Engle
*Assistant Examiner*—Thomas H. Webb
*Attorney, Agent, or Firm*—Louis A. Miller; Rolla N. Carter; Don D. Doty

[57] ABSTRACT

An underwater vehicle having a water-tight, disconnectably-sectioned, pressure-resistant, rugged, hull for carrying electronic instrumentation and other apparatus, a stabilizing tail section for altitude control, a manually adjustable negative-lift wing, and an adjustable bridle for the towing thereof by any suitable tractor vehicle.

2 Claims, 1 Drawing Figure

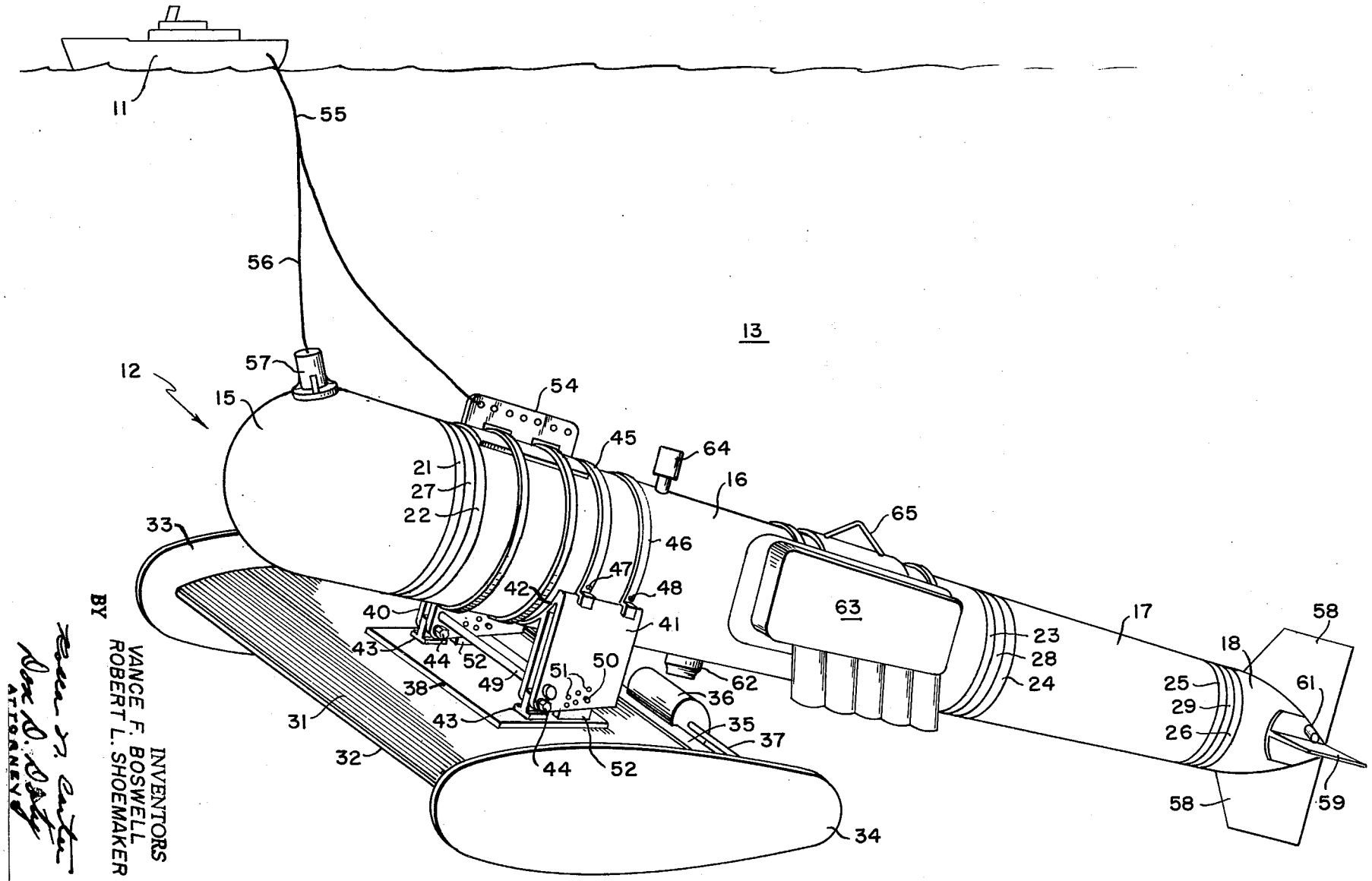
INVENTORS
VANCE F. BOSWELL
ROBERT L. SHOEMAKER
BY
Robert N. Carter
Don D. Doty
ATTORNEYS

UNDERWATER VEHICLE

The present invention relates generally to underwater vehicles and in particular is a fixed wing vehicle that has considerable attitude stability while being towed through a subaqueous medium by any pertinent towing vessel. In even more particular it is a towed submarine vehicle that is capable of being controlled to seek and substantially maintain itself at a predetermined distance above the sea floor within a given range of depths of the water.

It is frequently desirable to transport instruments and other apparatus at a certain distance above the ocean floor for the purpose of detecting, locating, and perhaps acting upon in some advantageous manner objects that may be laying thereon or submerged therein. Although the instant invention facilitates the detection and location of any predetermined objects, it is eminently suitable and primarily intended for being used in mine hunting and mine sweeping operations.

In the past, a variety of devices have been employed for this purpose, and although satisfactory for some purposes and during some operational circumstances, they appear to leave a great deal to be desired because they have, in general, been unwieldy, lack optimum controllability, are unreliable, and are relatively quite expensive.

The present invention overcomes many of the disadvantages of similar prior art devices in that it incorporates a substantially optimum structural configuration which results in a performance that is a considerable improvement thereover.

It is, therefore, an object of this invention to provide an improved towable submarine vehicle.

Another object of this invention is to provide a underwater vehicle having an improved structural and control surface configuration.

A further object of this invention is to provide an underwater vehicle that is capable of being controlled to maintain a predetermined attitude and distance above the sea floor while being towed by a surface or other vehicle.

Still another object of this invention is to provide an underwater vehicle that may incorporate a plurality of disconnectable sections joined together by waterproof joints.

Still another object of this invention is to provide a submarine vehicle which incorporates a wing means that maintains a fixed angle of attack while it is being towed within a subaqueous medium.

A further object of this invention is to provide a submarine vehicle having a wing-type control surface means, the angle of attack of which may be manually adjusted by a human operator when accessible thereto, so as to cause the vehicle to run as a fixed-wing vehicle at a predetermined attitude and depth of water while being towed therein.

Other objects and many of the attendant advantages will be readily appreciated as the subject invention becomes better understood by reference to the following detailed description when considered in conjunction with the accompanying drawing wherein:

The FIGURE is a pictorial representation of the subject invention being towed within an aqueous medium by a ship.

Referring now to the drawing, there is shown a ship 11 towing a submarine vehicle 12 within sea water 13 at some predetermined distance above the sea floor. Although vehicle 12 is herewith shown as being towed by a ship, it should be understood that any other tractor means such as a surface vessel, submarine vehicle, or aircraft that is suitably adapted for such purpose may likewise be used to tow submarine vehicle 12 without violating the spirit and scope of this invention.

In this particular embodiment, submarine vehicle 12 is so constructed as to facilitate the housing of various and sundry devices used for mine hunting, sweeping, and neutralization operations, each of which may or may not be unique devices per se. However, it would be obvious to one skilled in the art that this invention may also house and transport many other devices that are or may be employed for entirely different purposes, such as, for instance, instruments pertinent to oceangraphic research, possibly to antisubmarine warfare, or the detection and destruction of other unwanted objects submerged within sea water or the like. Regardless of the type of equipment or apparatus housed and transported therein, the submarine vehicle constituting this invention provides an eminently satisfactory method and means for performing many underwater functions in view of its maneuverability, platform stability characteristics, controllability, and strong waterproof construction that allows it to operate at considerable depths.

In addition, although only one such vehicle is disclosed as being towed by ship 11, it may be towed in pairs or in any other plurality, as a part of a towed array, if desired.

Considering now the subject vehicle itself, it is shown as having four hull sections consisting of a nose section 15, a forward intermediate section 16, a rearward intermediate section 17, and a tail section 18. These hull sections are preferably fabricated from a cast epoxy resin that is reinforced with fiberglass matting, although it should be obvious that any other suitable material may be substituted therefor. Aluminum end-rings 21 through 26 are respectively cast integrally with appropriate ends of the shell or wall of each of hull sections 15 through 18, and these rings co-act with other structural members to form waterproof joints 27, 28, and 29, which respectively hold the aforesaid hull sections together as a unitary hull. Although many conventional joints may be used as the aforementioned joints 27, 28, and 29, preferably the type of joint disclosed in U.S. Pat. No. 2,792,242 to Halley H. Hamlin should be used therefor, inasmuch as it provides the waterproof, strength, and structural characteristics needed for the optimum operation of this invention.

Attached to the forward intermediate hull section is a wing 31 having a negative lift section 32 and a pair of stabilizing side plates 33 and 34 rigidly affixed to opposite ends thereof. As will be mentioned again, the angle of incidence of wing 31 is manually adjustable, but in addition to this, it includes an aileron 35, controlled by a reversible motor 36 mounted thereon having a shaft 37 fixidly attached to at least one of the aforementioned side plates 33 and 34 in such manner that when the motor runs in either direction, both aileron and motor move up or down, as the case may be. Of course, the control of said motor is effected by other conventional motor control apparatus located either in the hull of vehicle 12 or in ship 11, as necessary for meeting any given operational circumstances.

Wing 31 is connected to hull section 16 by means of a base plate 38 connected to the upper surface of the lift section thereof by any suitable conventional means, such as bolts, a pair of brackets 40 and 41 having an upper saddle plate 42, contoured to be complementary in shape to fit the external surface of hull 16, are connected to plate 38 by angles 43 and by suitable bolts 44. Angles 43 may, likewise, be held to plate 38 by welding or perhaps by the aforesaid bolts, or any other suitable conventional means. A plurality of metal straps 45 and 46 hold brackets 40 and 41 and saddle plate 42 at the proper position along the length of hull section 16. Connection of straps 45 and 46 may be made to said brackets by any suitable conventional connecting means, such as bolts 47 and 48. A brace 49 may be inserted between brackets 40 and 41 to increase the strength thereof if desired. The aforesaid strap and bracket arrangement is, of course, preferable because it facilitates the removal and installation of the entire wing assembly from the hull, and also allows it to be positioned in such manner to vary the center of gravity and center of lift of the entire submarine vehicle.

The angle of attack may also be easily adjusted by the insertion of bolts 50 in any holes 51 while using bolts 44 as a pivot. Of course, said holes 51 mate with similar holes in rear angles 52 connected to the aforesaid base plate 38.

A tow line 55 interconnects ship 11 and a towing lug 54 in such manner that considerable flexibility exists in the towing angle and, hence, the distance that may be maintained between said ship 11 and the subject vehicle 12 during any given operational conditions.

The electrical conductors 56 and other control cables, if any, are likewise carries to the ship by tow line 55. They are supplied to vehicle 12 through a packing gland or watertight connector 57 attached to and extending through nose section 15 thereof.

The tail section of vehicle 12 includes both vertical stabilizing fins 58 and horizontal control elevators 59, the latter of which is position controlled by an elevator actuator mechanism 61 of any preferred conventional type.

Submarine vehicle 12, as previously mentioned, is intended to act as a carrier of a variety of apparatus, both internally and externally. For example, an echo-ranging transducer 62 of the electroacoustical type may be mounted on the bottom thereof if the subject vehicle is being run at a predetermined distance from the ocean bottom or if it is being used in mine hunting operations. Likewise, a housing 63 for a squib ejected transponder may be strapped to the vehicle, and a beacon transducer 64 may also be mounted theron. A lifting lug 65 may also be mounted thereon. A lifting lug 65 may also be strapped to the vehicle hull in order to facilitate the launching and retrieving thereof by a suitable crane or the like located aboard ship or on any suitable dock facility. Other useful items may be attached to this invention in accordance with the dictates of any given parameter seeking operation or any other given operational circumstances, inasmuch as so doing would obviously be well within the purview of one skilled in the art having the benefit of the teachings herewith presented.

The operation of the invention will now be discussed briefly as follows:

The submarine vehicle 12, while hanging from a suitable crane by its lifting lug 65, has its wing 31 adjusted to have the desired angle of attack. It is then submerged into the water and its tow line 55 let out sufficiently and appropriately to allow it to be drawn toward the sea floor as it is being towed by ship 11. As it approaches its submarine destination, other control apparatus (which may be conventional or also may be unique but is not considered to be included in this invention per se) may cause ailerons 35 and elevators 59 to be adjusted to control the attitude and position thereof at some useful distance above the bottom of the ocean. Of course, the combined forces on the tow line, said ailerons, and elevators effect the proper substantially stabilized platform type or running of the submarine vehicle constituting this invention, so that it, in turn, will be useful as a mine hunting or other submarine carrier vehicle.

As previously suggested, that equipment or apparatus which is pertinent to any given operation may be housed therein or mounted thereon in any suitable manner, and, accordingly, this invention may function as a sea probe for many practical purposes.

Obviously, many modifications and embodiments of the subject invention will readily come to the mind of one skilled in the art having the benefit of the teachings presented in the foregoing description in accompaniment with the associated drawing. Therefore, it is to be understood that the invention is not to be limited thereto and that said modification and embodiments are intended to be included within the scope of the appended claims.

What is claimed is:

1. A submarine vehicle adapted for probing predetermined ocean depths and transporting predetermined instruments and utilization equipment while being towed by an ancilliary tractor means comprising in combination, a hollow nose section, an intermediate hollow shell section joined to said hollow nose section, a hollow tail section joined to said hollow intermediate shell section, a wing having negative lift characteristics, means interconnecting the aforesaid intermediate hollow shell section and said wing for the support thereof in a predetermined fixed relative relationship, a pair of side plates respectively attached to the ends of said wing, an aileron connected to the trailing edge of said wing, means mounted on said aileron and connected to at least one of the aforesaid side plates for changing the position of said aileron with respect to said wing, lug means connected to said intermediate hollow shell section, means connected to the aforesaid lug means for supplying a towing force thereto, electrical conductor means extending through the aforesaid nose section and supported by said towing force supplying means for conducting electrical energy to the hollow thereof, and packing gland means attached to said nose section for passing said electrical conductor means therethrough in a water-tight manner.

2. A submarine vehicle adapted for being towed within sea water as a predetermined parameter and object probe comprising in combination, a hull comprising a nose section, at least one intermediate section, and a tail section, a plurality of water-proof joints respectively interconnecting said nose, intermediate, and tail sections, a pair of vertical stabilizing fins attached to the tail section of said hull, a pair of adjustable horizontal elevators attached to the tail section of said hull, means mounted on said hull for adjusting the position of said elevators, a pair of substantially parallel brackets, means interconnecting said brackets for rigidly supporting same in a fixed relative relationship, a curved saddle plate interconnecting said parallel brackets, with the curve thereof complementary with the outer surface of the intermediate section of said hull, and with said curved saddle plate disposed in abutment with the aforesaid complementary outer surface of the intermediate section of said hull, a plurality of removable straps connected to said pair of brackets and extending around the intermediate section of said hull in such manner as to effectively secure said brackets thereto, a base plate effectively interconnecting said pair of brackets at the edges thereof opposite the edges said curved saddle plate is attached thereto, a wing having negative lift characteristics connected to said base plate, a first side stabilizing plate attached to one end of said wing, a second side stabilizing plate attached to the other end of said wing, means interconnecting said base plate and said pair of brackets for adjustably securing said wing at a fixed angle of incidence relative to the longitudinal axis of said hull, adjustable aileron means attached to the trailing edge of said wing, motor means mounted on said aileron means and connected to at least one of said side plates for adjusting the position of said aileron means relative to the aforesaid wing, lug means connected to said hull, and means connected to said lug means for supplying a towing force thereto.

* * * * *